United States Patent [19]

Kennedy

[11] Patent Number: 4,664,015

[45] Date of Patent: May 12, 1987

[54] AUTOMATIC GUN WITH IMPROVED FIRING MECHANISM

[76] Inventor: Joseph E. Kennedy, 300 College St., Smyrna, Tenn. 37167

[21] Appl. No.: 758,350

[22] Filed: Jul. 24, 1985

[51] Int. Cl.[4] ..... F41D 11/02

[52] U.S. Cl. ..... 89/138; 89/141; 89/142

[58] Field of Search ..... 42/69.03; 89/138, 139, 89/140, 141, 142, 145

[56] References Cited

U.S. PATENT DOCUMENTS

| | | | |
|---|---|---|---|
| 981,210 | 1/1911 | Menteyne et al. | 89/138 |
| 1,077,103 | 10/1913 | Smith | 42/69.03 |
| 1,294,506 | 2/1919 | Martin | 42/69.03 |
| 2,341,780 | 2/1944 | Horan | 42/69.03 |
| 2,931,120 | 4/1960 | Kolinko | 89/138 |
| 3,678,800 | 7/1972 | Moller et al. | 89/142 |

*Primary Examiner*—Stephen C. Bentley

[57] ABSTRACT

A gun which has an improved firing mechanism which enables it to be completely automatic through ejection of the magazine by eliminating the need for a selector switch. The firing mechanism has a substantially J-shaped hammer with a sear embedded therein. The sear is shaped, preferably hemispherically, at its framework end so that it will fall into a recess in the framework during the firing cycle. The draglink has a curved upper surface which is preferably concave or bowl-shaped. An associated magazine follower has a cam at its front center for tripping a release latch.

4 Claims, 4 Drawing Figures

AUTOMATIC GUN WITH IMPROVED FIRING MECHANISM

BACKGROUND OF THE INVENTION

1. Field of the Invention

This invention relates to automatic guns. More particularly, it relates to a gun which has an improved firing mechanism.

2. Description of the Prior Art

Until now much time has been lost in infantry operations because of the necessity of using a selector switch to change to automatic when a rifleman needs to fire more than single shots. Additional time is lost in having to manually remove a magazine when more rounds have to be fired.

SUMMARY OF THE INVENTION

After extended investigation I have found that by providing in a firing mechanism a substantially J-shaped hammer which has a sear embedded therein shaped so that it falls into a recess in the opposing framework during a firing cycle, I can eliminate the need for a selector switch. I prefer also to shape the upper surface of the draglink in a substantially concave or bowl-shaped manner. The shape of the sear is preferably substantially hemi-spherical at its end toward the recess for optimum firing results. To provide for automatic release of the magazine at the proper time, I supply a cam at the front center of an associated magazine follower.

BRIEF DESCRIPTION OF THE DRAWING

For a better understanding of my invention reference will now be made to the drawing which forms a part hereof and represents a preferred embodiment of the invention.

In the drawing.

DETAILED DESCRIPTION OF THE INVENTION

Figure 1:
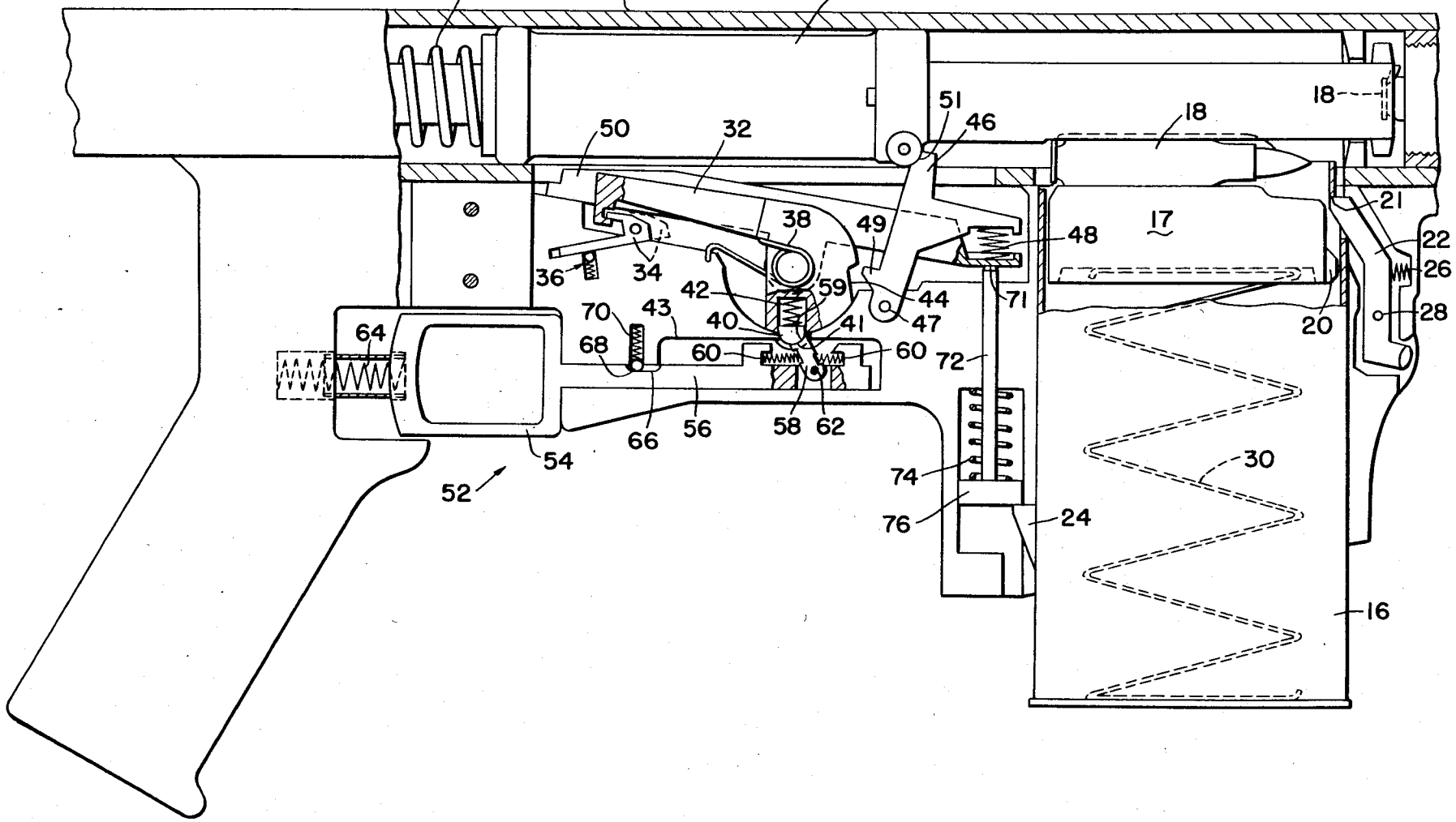
FIG. 1 is a longitudinal view, partially broken away in cross-section, of a gun having an improved firing mechanism according to the invention as it appears before firing and ready for firing.

Referring now to FIG. 1 of the drawings, a weapon 10 is shown in partial side elevation, with certain components of the weapon being exposed. A bolt 14 is shown located in a receiver 12. Behind the bolt is a coil spring 15. A magazine 16 containing a round of ammunition 18 is shown located forwardly of receiver 12 and held in place in a lower opening in the receiver by a latch 22 engaging a ledge 21 of the magazine wall. A sole round or cartridge 18 is shown resting on a "follower" 17, which in turn, is held against the cartridge by a spring 30.

The side of the magazine opposite latch 22 has a protrusion 24 that functions, as explained below, to thrust the magazine from weapon 10.

A hammer 32 is pivotally mounted beneath receiver 12 and in a circular depression of a frame 43 of the weapon. The hammer is held in a non-firing position by a safety latch 34 and against the tension of a spring 38. One end of the spring is seated in frame 43 of the weapon while the other end seats against an opposing surface of the hammer.

A sear 40 is spring mounted at 42 in a rounded hub of the hammer, the sear having a rounded, spherical shape 41. It is held in a lower opening in the frame by spring 42 when the hammer is in the position depicted in FIG. 1.

At a location immediately forward of the hammer is an auto-trip means 46 that pivots at 47 and is biased by a spring 48. Spring 48 also engages one end of an elongated bolt stop 50 that pivots at the same location as the hammer and extends from 48 to a rearward location that locks bolt 14 in a rearwardmost position in a manner explained in greater detail hereinafter.

Spring 48 is mounted to push up on auto-trip 46 and push down on bolt stop 50.

A straightpull trigger assembly 52 is located beneath hammer 32. The assembly includes an integral trigger and trigger guard 54, and a forwardly extending arm 56. In the forward end of arm 56 is located draglink 58 having an upper rounded surface 59 provided to suitably engage the rounded shape of sear 40. Two springs 60 located respectively on opposed sides of the draglink seek to maintain the link in a neutral position about pivot means 62.

Trigger assembly 52 is biased in a forward position by a coil 64 located behind the trigger structure and in a handle or stock portion of the weapon. Spring 64 maintains the trigger assembly in the forward position shown in FIG. 1. A slot 66 provided in extension arm 56 seats a ball 68 under force of a spring 70 located in a recess provided in weapon frame 43.

Beneath spring 48 is located a vertically positioned rod 72. A coil spring 74 is located around the rod and in a recess provided in frame 43. The spring extends between a lower piston 76, sized to move vertically in the recess, and the upper end of the recess. The lower end of the recess is open to received protrusion 24 of magazine 16. The upper surface of the protrusion engages the lower surface of piston 76 when the magazine is inserted in the weapon, and compressor spring 74 between piston 76 and the upper surface of the recess containing the spring.

The operation of weapon 19 is as follows:

A magazine containing one or more rounds is inserted into receiver 12. This releases bolt 14 in a manner explained below.

The user of the weapon moves safety latch 34 away from hammer 32, as shown in phantom in FIG. 1. Being released, bolt 14 is pushed forward by spring 15 to strip a cartridge from the magazine and chamber the same for firing. The bolt has also moved against autotrip 46, making contact via a bearing surface 51 on the bolt.

The fire weapon 10, trigger 54 is pulled toward the rear of the weapon so that draglink 58 pushes sear 40 into the hammer and free of the opening in frame 43. The hammer now snaps forward under force of spring 38 to fire the chambered round by striking a firing pin (not shown) that extends through the forward portion of bolt 14. The bolt then unlocks and recoils from the pressure of the explosion (and the spent round is ejected from the receiver). Contact with auto-trip 46 is broken as the bolt moves to the rear.

In traveling to the rear the bolt engages the upright hammer (FIG. 2) and proceeds to rotate it in the rounded recess in frame 43 to the home position of the hammer when the bolt reaches its home position in the receiver.

Bolt spring 15 is now compressed. The sear 40 which has been kept in the hub of the hammer by the rounded surface of the recessed frame is now released to seat in the opening in the frame. Also, auto-trip 46 (protrusion 49) seats in a notch 44 provided in the hub of the hammer (see FIGS. 3 and 4) under force of spring 48. The pressure of compressed spring 15 starts the bolt forward again, the bolt stripping another cartridge from the magazine. The bolt again engages autotrip, as in FIG. 1 and 2, which removes protrusion 49 from the recess in the hammer hub.

The sear 40 is now the only item holding the hammer in its home position. The user of weapon 10 now has the choice of pulling the trigger further to the rear or releasing it. If the user allows the trigger to move forward to its original (home) position under the force of spring 64, the draglink 58 is titled to rearward position and thus slides under sear 40 without dislodging the same from the opening in frame 43. The draglink is now ready to repeat the above cycle, i.e., to dislodge the sear and free the hammer to fire another round. This action of firing one round at a time can be repeated until magazine 16 is empty.

Figures 3, 4:
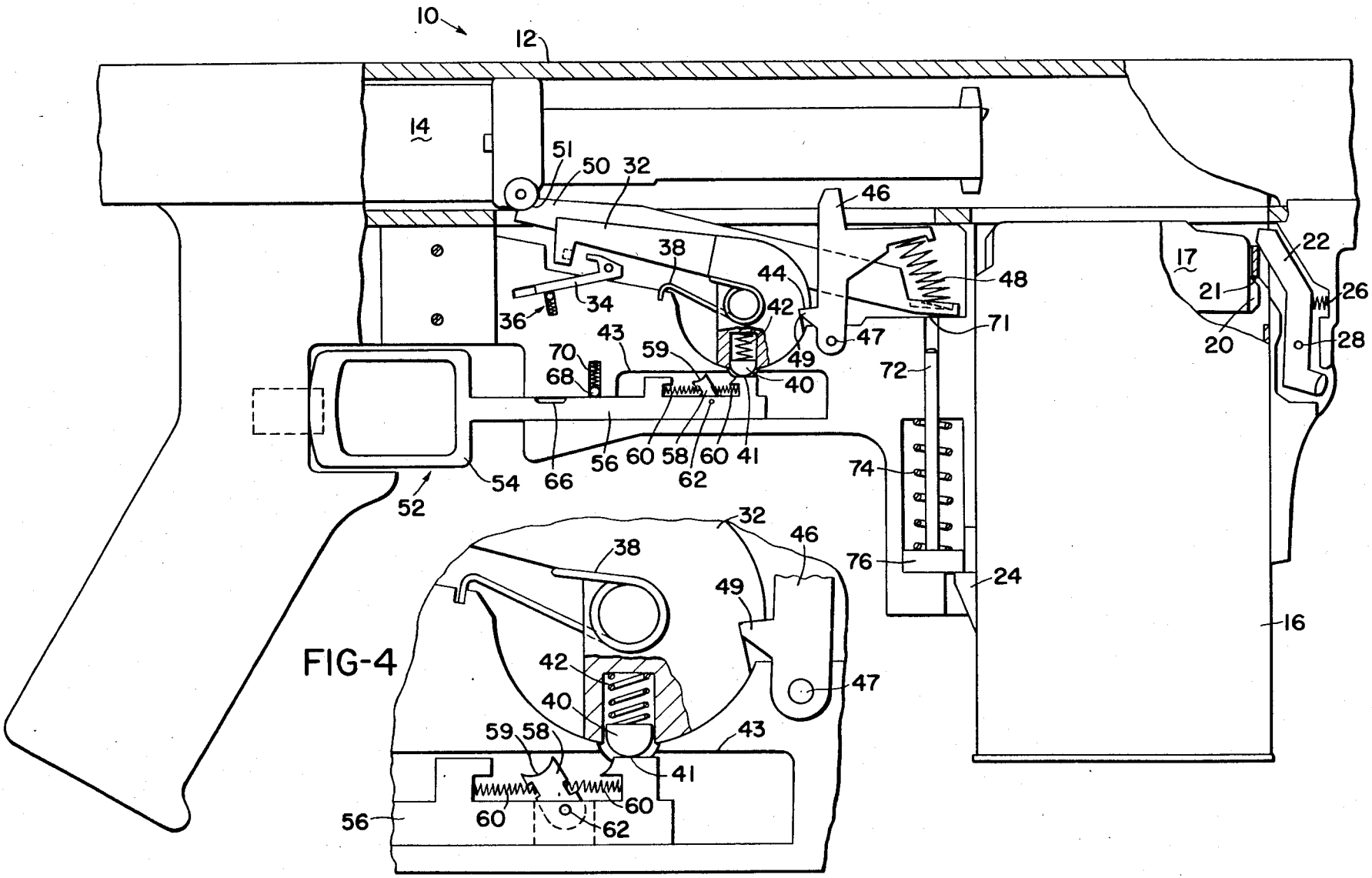
FIG. 3 shows the gun of FIG. 1 as it appears after the trigger has been held back so as to automatically fire more than a single round.
FIG. 4 is an enlarged breakaway showing the draglink-seer-trip area of the gun of FIG. 3.

If, however, the user continues to pull the trigger to the rear, a raise portion on the forward end of arm 56 closes the opening in the frame such that the sear cannot fully enter the same when the hammer is returned to its known position by the returning bolt, see FIGS. 3 and 4. The hammer, thus, is free to snap forward again and again and fire successive cartridges that are repeatedly stripped and chambered by the bolt that is again and again thrust forward by spring 15. This continues automatically as long as the trigger is pulled to and held in its rearwardmost position, until the magazine is emptied.

When the last round is stripped from the magazine, follower 17 reaches its uppermost position in the magazine, see FIG. 3. A follower cam 20 engages latch 22 to move it out of the way of ledge 21. The magazine is now free of the receiver, and the force of compressed spring 74 ejects the magazine by moving piston 76 against protrusion 24 on the magazine. In FIG. 3, the magazine is on its way out. Spring 74 will eject the magazine in any position of the weapon so that the user does not have to rely on the force of gravity, i.e., weapon 10 will not retain an empty magazine.

With spring 74 extended in the process of ejecting the magazine (FIG. 3) rod 72 has moved away from the end of bolt stop 50, which seats spring 48. This rotates the bolt stop about its pivot and thus tips the other end of the bolt stop upwardly to engage bearing surface 51 of the bolt (FIG. 3) when the bolt recoils to its home position. This locks the bolt in home position.

When a magazine containing one or more rounds is inserted into the receiver, protrusion 24 engages piston 76 to raise the same and to raise rod 72 into engagement with the bolt stop at 71 (see FIG. 1). This rotates the other end of the bolt stop downwardly and out of engagement with the bolt. The bolt now travels forward under force of spring 15 to strip around from the new magazine and chambers the same. The new magazine is, of course, locked into place by latch 22 engaging the wall of the magazine 21.

Thus, when using a gun with a firing mechanism according to the invention, the operator needs only to load and fire his weapon. He can fire multiple shots without stopping to turn a selector switch. He does not have to manually release an empty magazine. The location of magazine release 22 in the front center of the housing also permits easy access with either hand.

Figure 2:
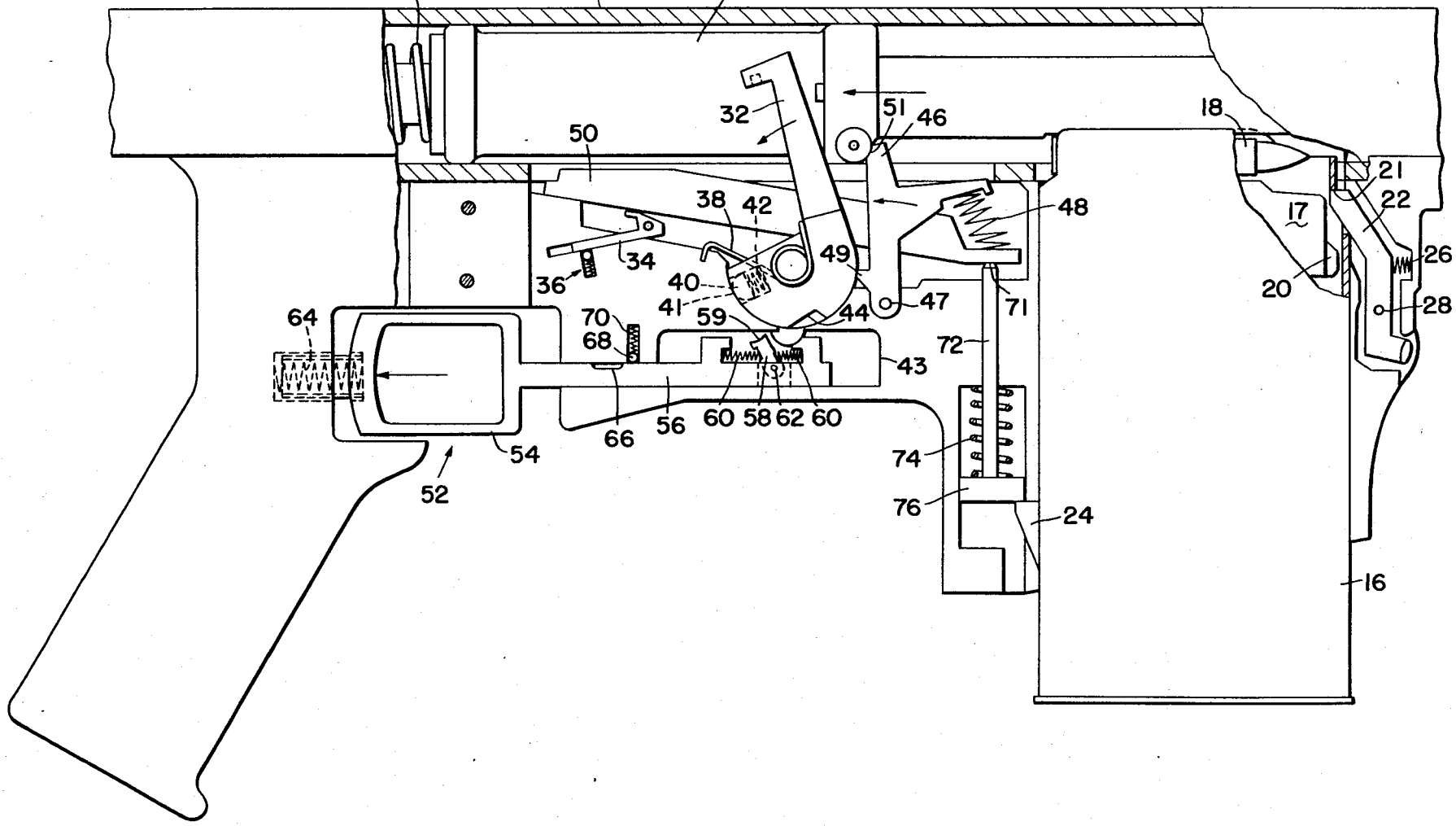
FIG. 2 depicts the gun of FIG. 1 as it appears after firing a single round of ammunition.

Further, and more specifically with respect to the cycle used in operating the gun with improved firing mechanism of the invention, pulling trigger 54 to the rear allows drag link 58 to contact sear 40. As drag link 58 pivots up, it pushes sear 40 up into hammer 32. When sear 40 breaks free from framework 43, hammer 32 snaps forward, firing the weapon in a manner such as shown in FIG. 2. As bolt 14 unlocks (see spring 15 in FIG. 1) and is moved to the rear, contact is broken with automatic trip 46, which has a spring 48 in association therewith and pivots at 47, and automatic trip 46 is pressed against hammer 32, which has a safety latch 34 with a position ball and spring 36 therefor and a tension spring 38, pushing hammer 32 back and down into framework 43. When bolt 14 reaches its most rearward point, automatic trip 46 has engaged notch 44 in hammer 32 at protrusion or protrusion point 49 of automatic trip 46. Sear 40 has been pushed down into the recess in framework 43. Immediately after sear 40 breaks loose, draglink 58 is returned to its neutral position, having equal spring tension on each side as depicted in FIG. 1. At this point in the cycle, with trigger 54 in a semi-position or halfway between semi and fully automatic positions (see FIG. 2), trigger 54 may be released to home position of FIG. 1 or be pulled to its most rearward point (see FIG. 3). If trigger 54 is released, draglink 58 slides under sear 40 until it has been cleared and returned to the neutral position of FIG. 1, the gun then being ready to fire again and repeat the cycle.

As may be seen from the foregoing description, advantages of my invention include the lack of a selector switch, a straight-pull trigger, the capability of firing single or multiple shots, an sutomatic magazine ejector, an increase in the rate of fire, chambering of the first cartridge by releasing the bolt upon insertion of a loaded magazine, prvention of the possibility of retaining an empty magazine, and combination of trigger and trigger guard.

While the invention has been described in terms of preferred embodiments, the claims appended hereto are intended to encompass all embodiments which fall within the spirit of the invention.

Having thus described my invention and certain preferred embodiments thereof, I claim:

1. A firing mechanism and magazine release means for an automatic weapon, comprising:

- a straight pull trigger integral with a trigger guard and a forwardly extending arm,
- a draglink located in said arm,
- a rounded sear and hammer located above the forwardly extending arm, said sear being resilently mounted in the hammer,
- a frame structure having a rounded recess for seating and engaging a rounded portion of the hammer, and an opening therein for receiving the sear at a location over the forward arm of the trigger and adjacent the draglink when the hammer is located in a non-firing position,
- a receiver located above the trigger and hammer,
- a bolt positioned to travel through the receiver until it chambers a round, auto-trip means located adjacent the hammer and receiver for holding the hammer in a non-firing position when the magazine is empty and for releasing the same when the magazine contains one or more rounds and the trigger is pulled either to its most rearward position or to an intermediate position, and means located adjacent the end of the forward arm for closing the opening in the frame when the trigger is pulled to its most rearward position.

2. The firing mechanism of claim 1 including a magazine follower having cam means for moving a latch holding a magazine in place in the weapon to a release position which clears the magazine for removal from the weapon.

3. The firing mechanism of claim 2 in which a rod means is spring mounted at a location adjacent the magazine to remove the same from the weapon when the latch is moved to a release position by the magazine follower.

4. The firing mechanism of claim 3 including a bolt stop positioned to lock the bolt in a rearwardmost position when the magazine is empty and to release the bolt when a magazine containing one or more rounds is inserted into the weapon, the magazine engaging the rod means and forcing the same to engage the bolt stop such that the bolt stop is moved away from the bolt.

* * * * *